US007448743B2

(12) United States Patent
Itoh

(10) Patent No.: US 7,448,743 B2
(45) Date of Patent: Nov. 11, 2008

(54) INK JET PRINTER HAVING A PRINT MISALIGNMENT DETECTION SENSOR

(75) Inventor: Yuichiro Itoh, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 297 days.

(21) Appl. No.: 11/334,356

(22) Filed: Jan. 19, 2006

(65) Prior Publication Data

US 2006/0158500 A1 Jul. 20, 2006

(30) Foreign Application Priority Data

Jan. 20, 2005 (JP) ..... 2005-012700

(51) Int. Cl.
*B41J 2/01* (2006.01)
*B41J 29/38* (2006.01)
*B41J 29/393* (2006.01)

(52) U.S. Cl. ..... 347/101; 347/16; 347/19

(58) Field of Classification Search ..... 347/101, 347/16, 19
See application file for complete search history.

(56) References Cited

U.S. PATENT DOCUMENTS 5,170,047 A * 12/1992 Beauchamp et al. ..... 250/202
5,397,192 A * 3/1995 Khormaee ..... 400/708
5,404,020 A * 4/1995 Cobbs ..... 250/548
5,451,990 A * 9/1995 Sorenson et al. ..... 347/37
5,905,512 A * 5/1999 Beauchamp ..... 347/19
6,312,082 B1 * 11/2001 Lund et al. ..... 347/19
6,416,153 B1 7/2002 Pan et al.
6,655,778 B2 * 12/2003 Arquilevich et al. ..... 347/19
7,167,248 B2 * 1/2007 Kato ..... 356/446
7,285,771 B2 * 10/2007 Walker ..... 250/239

FOREIGN PATENT DOCUMENTS

JP 2000-109243 A 4/2000
JP 2001-253149 A 9/2001
JP 2003-512984 4/2003
WO WO 01/32427 A1 5/2001

* cited by examiner

*Primary Examiner*—Stephen D Meier
*Assistant Examiner*—Leonard S Liang
(74) *Attorney, Agent, or Firm*—Crowell & Moring LLP

(57) ABSTRACT

An ink jet printer comprises a print misalignment detection sensor having a support member for supporting an LED and a PD. The support member is mounted on a cradle holding a printing head, and is open on its cradle-mounting side. The support member has U-shaped light transmitting and receiving grooves respectively forming a light transmitting path from the LED and a light receiving path to the PD. The cradle has light transmitting and receiving path ribs, each with a semicircular recess formed at its end. The two ends of the two light path ribs are respectively inserted into the two light grooves so as to cause the two light paths at the insertion positions to each have a round shape as seen in cross-sectional view. This reduces irregular reflection of light in the two light paths, thereby reducing noise in an output signal of the print misalignment detection sensor.

4 Claims, 5 Drawing Sheets

A – A

B – B

INK JET PRINTER HAVING A PRINT MISALIGNMENT DETECTION SENSOR

BACKGROUND OF THE INVENTION

1. Field of the Invention

The present invention relates to an ink jet printer having a print misalignment detection sensor for detecting misalignment of an image printed on a paper.

2. Description of the Related Art

A conventional ink jet printer has a printing head for printing an image on a paper, and a print misalignment detection sensor for detecting misalignment of the image printed on the paper in order to correct the image misalignment. The printing head is held by a cradle mounted on a carriage which is controlled to move along the paper. When the cradle is moved by the carriage, the printing head is moved along the paper together with the cradle, and ejects ink to print an image on the paper.

The print misalignment detection sensor is mounted on the cradle holding the printing head, and is moved along the paper together with the cradle and the printing head as the cradle is moved by the carriage. The print misalignment detection sensor irradiates light onto the paper, and receives reflection light from the paper so as to output a signal corresponding to an intensity of the received light. Based on the output signal of the print misalignment detection sensor, misalignment of the image printed by the printing head on the paper is detected so as to make various adjustments for correcting the image misalignment.

The print misalignment detection sensor comprises: a light-emitting element for emitting light to be irradiated onto a paper; a light-receiving element for receiving reflection light reflected from the paper; and a support member fixed to the cradle for supporting these light-emitting element and light-receiving element. The support member has a light transmitting groove having a substantially U-shaped cross section to form a light transmitting path of light emitted from the light-emitting element, and also has a light receiving groove having a substantially U-shaped cross section to form a light receiving path to the light-receiving element. The support member has an opening on a cradle-mounting side thereof to mount the support member on the cradle. The print misalignment detection sensor is mounted on the cradle with the opening of the support member being open on the cradle-mounting side.

However, in such conventional printer, the light emitted from the light-emitting element causes irregular reflection in the light transmitting path and the light receiving path, so that a waveform of the output signal of the print misalignment detection sensor has noise generated therein. The reason for the irregular reflection is that the cross section of the light transmitting path and the light receiving path is U-shaped, and that the opening of the print misalignment detection sensor is open on the cradle-mounting side. This causes a problem that it is not possible to correctly detect misalignment of an image printed on a paper, and to properly correct the image misalignment.

Besides, there are several known printers with carriages having optical sensors for various purposes. For example, a known printer has an optical sensor for sorting print media (refer to e.g. Japanese-translated Laid-open Publication of International Patent Application 2003-512984). Another known printer has an optical sensor for detecting an image printed on a paper to correct an upper end position of a page (refer to e.g. Japanese Laid-open Patent Publication 2001-253149). Yet another known printer has an optical sensor for detecting position of a printing paper (refer to e.g. Japanese Laid-open Patent Publication 2000-109243). However, none of the technologies of these printers can solve the above-described problem.

SUMMARY OF THE INVENTION

An object of the present invention is to provide an ink jet printer that can reduce noise in an output signal of a print misalignment detection sensor.

According to the present invention, the object is achieved by an ink jet printer for printing an image on a paper, comprising: a printing head for ejecting ink to print an image on a paper; a cradle for holding the printing head; a print misalignment detection sensor comprising a light-emitting element for irradiating light onto the paper and a light-receiving element for receiving reflection light from the paper so as detect misalignment of an image printed on the paper; and a support member for supporting the light-emitting element and the light-receiving element and for being mounted on a side surface of the cradle.

Therein, the support member comprises (i) a light transmitting groove having a substantially U-shaped cross section to form a light transmitting path of light emitted from the light-emitting element, (ii) a light receiving groove having a substantially U-shaped cross section to form a light receiving path to the light-receiving element, and (iii) an opening on a cradle-mounting side thereof. The cradle comprises a rib being provided on and projected from the side surface thereof to mount the support member, and being inserted into the light transmitting groove and/or the light receiving groove, and further having a semicircular recess at an end thereof. Further, the semicircular recess of the rib inserted into the light transmitting groove and/or the light receiving groove causes the light transmitting path and/or the light receiving path at the insertion position to have a round shape as seen in cross-sectional view.

According to the present invention, the rib of the cradle is inserted into the light transmitting groove and/or the light receiving groove of the print misalignment detection sensor so as to cause the light transmitting path and/or the light receiving path to have a round shape at the insertion position of the rib, thereby cutting unnecessary light. This reduces irregular reflection of light in the light transmitting path and/or the light receiving path, making it possible to reduce noise in an output signal of the print misalignment detection sensor. Due to the reduced noise in the output signal of the print misalignment detection sensor, misalignment of an image printed on a paper can be accurately detected. This makes it possible to properly correct the image misalignment based on the detected image misalignment, and thereby to print a misalignment-free clear image on the paper. Furthermore, the rib provided on the cradle serves to position the print misalignment detection sensor, making it possible to easily mount the print misalignment detection sensor at a proper position.

Preferably, the mounting of the support member on the side surface of the cradle causes the opening of the support member to be closed. Due to the closing of the opening of the support member by the cradle, external disturbing light is cut. This further reduces irregular reflection of light in the light transmitting path and the light receiving path, making it possible to further reduce noise in the output signal of the print misalignment detection sensor. In addition, the side surface of the cradle can be used to close the opening of the print misalignment detection sensor on its cradle-mounting side, so that it is possible to save additional elements and reduce weight.

Further preferably, the cradle comprises a positioning boss provided on and projected from the side surface thereof to mount the support member, while the support member comprises a boss-fitting positioning hole for the positioning boss to be fitted to, and a rib insertion portion for the rib of the cradle to be inserted into.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein:

FIG. 2A is a schematic perspective view of a combination of a cradle with a print misalignment detection sensor mounted thereon in the printer before holding a printing head, while

FIG. 4A is schematic perspective view of a part of the cradle showing a sensor mounting surface of the cradle, while

DESCRIPTION OF THE PREFERRED EMBODIMENTS

Figure 1:
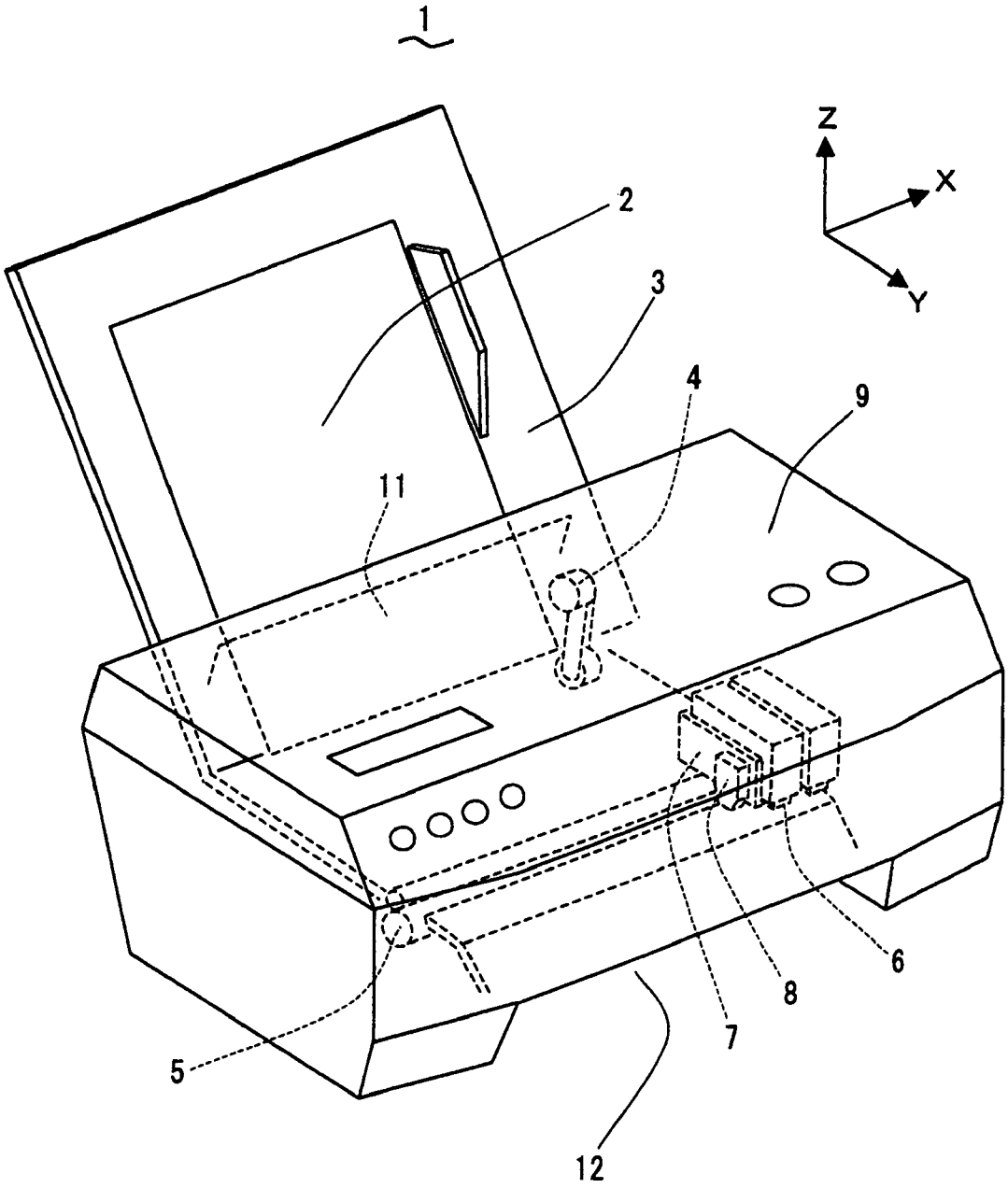
FIG. 1 is a schematic perspective view showing a structure of an ink jet printer according to an embodiment of the present invention.

The best modes and preferred embodiments of an ink jet printer according to the present invention will be described hereinafter with reference to the annexed drawings. Note that the specific embodiments described are not intended to cover the entire scope of the present invention, and hence the present invention is not limited to only the specific embodiments. Also note that like parts are designated by like reference numerals throughout the drawings.

FIG. 1 is a schematic perspective view showing a structure of an ink jet printer 1 according to an embodiment of the present invention. The printer 1 is a device for printing an image on a paper 2 based on image data input from a personal computer, a memory card, or the like. Referring to FIG. 1, the printer 1 comprises: a paper rest 3 for placing the paper 2 on; a paper feed roller 4 and a feed roller 5 for transporting the paper 2; a printing head 6 for printing an image on the paper 2; a cradle 7 for holding the printing head 6; a print misalignment detection sensor 8 for detecting misalignment of an image printed on the paper 2; and an outer casing 9 for containing these paper feed roller 4, feed roller 5, printing head 6, cradle 7 and print misalignment detection sensor 8. The outer casing 9 has a paper inlet 11 for supplying or feeding the paper 2, and a paper outlet 12 for discharging the paper 2.

The paper 2 is placed on the paper rest 3 with a lower end of the paper 2 being inserted in the paper inlet 11 of the outer casing 9. The paper 2 can be a single paper or a stack of multiple papers, but is assumed to be a single paper in the following description. The paper feed roller 4 transports the paper 2 placed on the paper rest 3 to the feed roller 5. The feed roller 5 transports the paper 2, transported from the paper feed roller 4, to the paper outlet 12 of the outer casing 9 via a path under the printing head 6.

The printing head 6 is of an ink jet type that ejects ink to print an image, and is held by the cradle 7. The cradle 7 is mounted on a carriage (not shown) which controls the cradle 7 to move along the paper 2 in a direction perpendicular to the transportation direction of the paper 2 (i.e. in X direction as shown in FIG. 1 and other Figures). As the cradle 7 is moved by the carriage, the printing head 6 together with the cradle 7 is reciprocated along the paper 2 in the direction perpendicular to the transportation direction of the paper 2. While reciprocating along or over the paper 2 transported by the feed roller 5, the printing head 6 ejects ink based on image data input thereto from e.g. a personal computer or a memory card, so as to print an image on the paper 2 transported by the feed roller 5.

The print misalignment detection sensor 8 is an optical sensor which receives light, and outputs a signal corresponding to an intensity of the received light. The print misalignment detection sensor 8 is mounted on the cradle 7, and is reciprocated along the paper 2 together with the printing head 6 held by the cradle 7 in the direction perpendicular to the transportation direction of the paper 2 as the cradle 7 is moved by the carriage. While reciprocating together with the printing head 6 along or over the paper 2 transported by the feed roller 5, the print misalignment detection sensor 8 irradiates light to the paper 2 so as to receive reflection light from the paper 2, and outputs a signal corresponding to an intensity of the received reflection light. The output signal of the print misalignment detection sensor 8 is input to a control circuit (not shown). Based on the output signal of the print misalignment detection sensor 8, the control circuit detects misalignment of the image printed on the paper 2, and makes various adjustments for correcting the image misalignment.

Figure 2A:
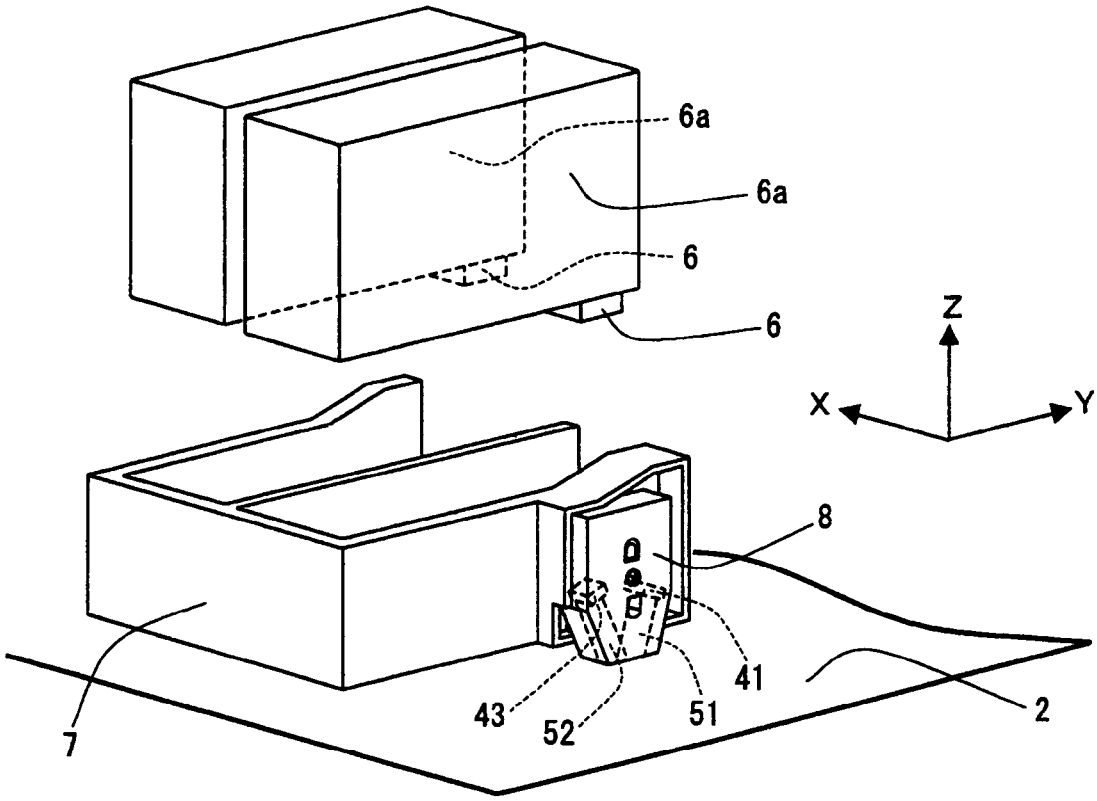
Figure 2B:
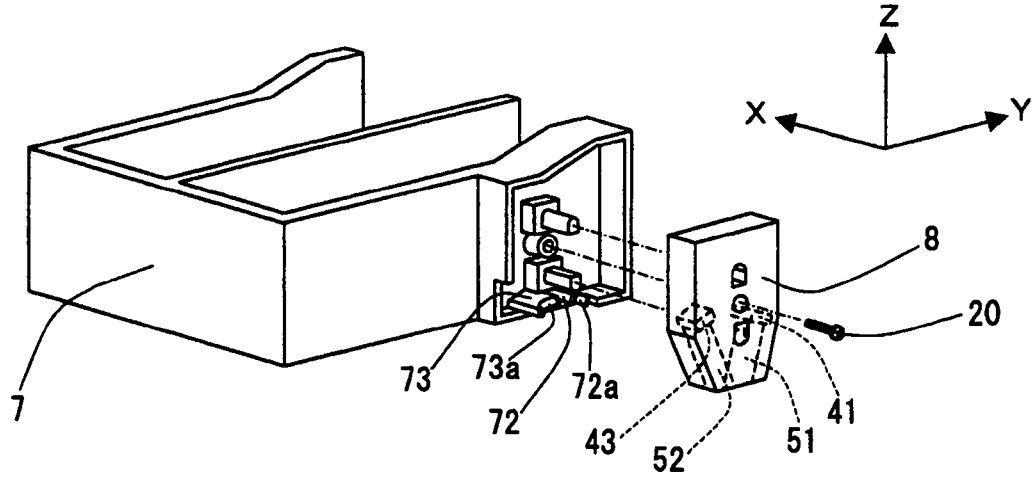
FIG. 2B is a schematic exploded perspective view of the combination.

FIG. 2A is a schematic perspective view of a combination of the cradle 7 with the print misalignment detection sensor 8 mounted thereon before holding the printing head 6, while FIG. 2B is a schematic exploded perspective view of the combination. As described above, the cradle 7 holds the printing head 6, and has the print misalignment detection sensor 8 mounted thereon. The printing head 6 has an ink cartridge **6*a* integral therewith, and is detachably held by the cradle 7 so as to be replaceable by a new printing head when the ink cartridge runs out of ink contained therein. The print misalignment detection sensor 8 is mounted on a side of the cradle 7 so as to irradiate light onto the paper 2 and receive reflection light from the paper 2, and is fixed to the cradle 7 with a screw 20**.

Figure 3A:
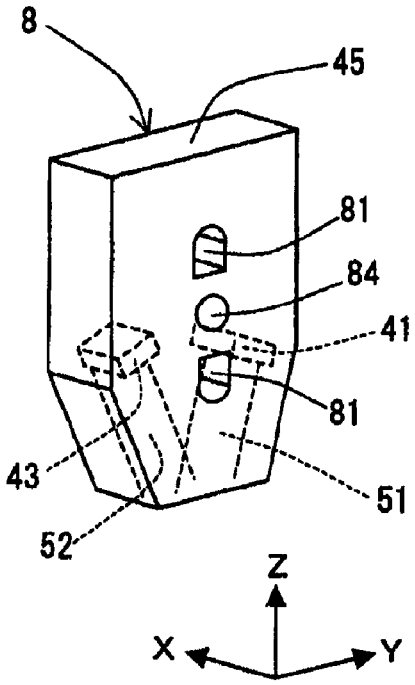
FIG. 3A is a schematic perspective view of the print misalignment detection sensor as seen from outside.
Figure 3B:
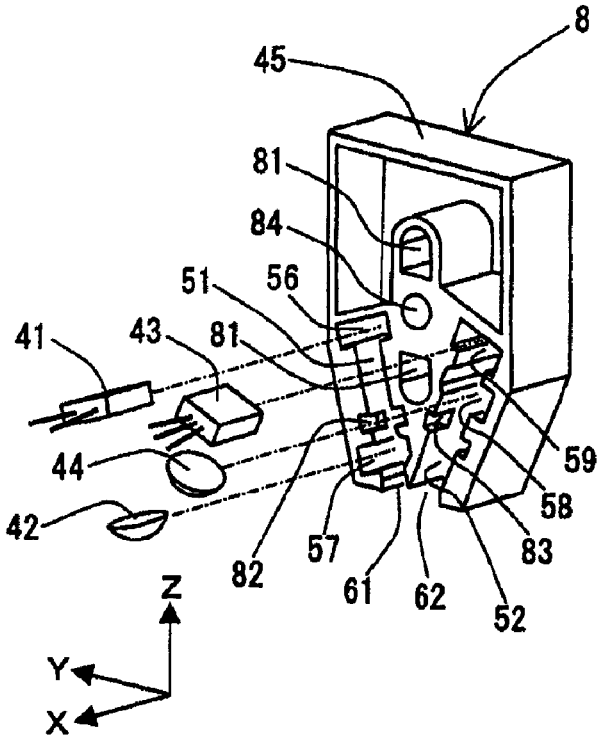
FIG. 3B is a schematic exploded perspective view of the print misalignment detection sensor as seen from the cradle-mounting side.
Figure 3C:
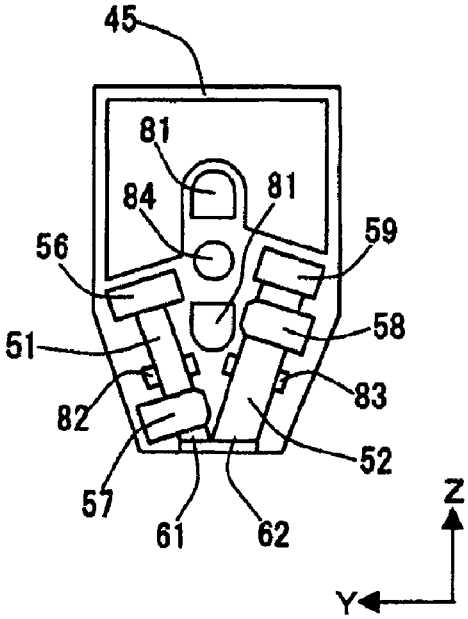
FIG. 3C is a schematic front view of the print misalignment detection sensor showing a structure of its support member.
Figure 3D:
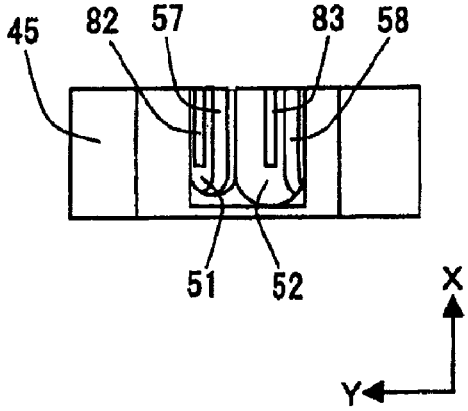
FIG. 3D is a schematic bottom plan view of the print misalignment detection sensor showing the structure of the support member.
Figure 4A:
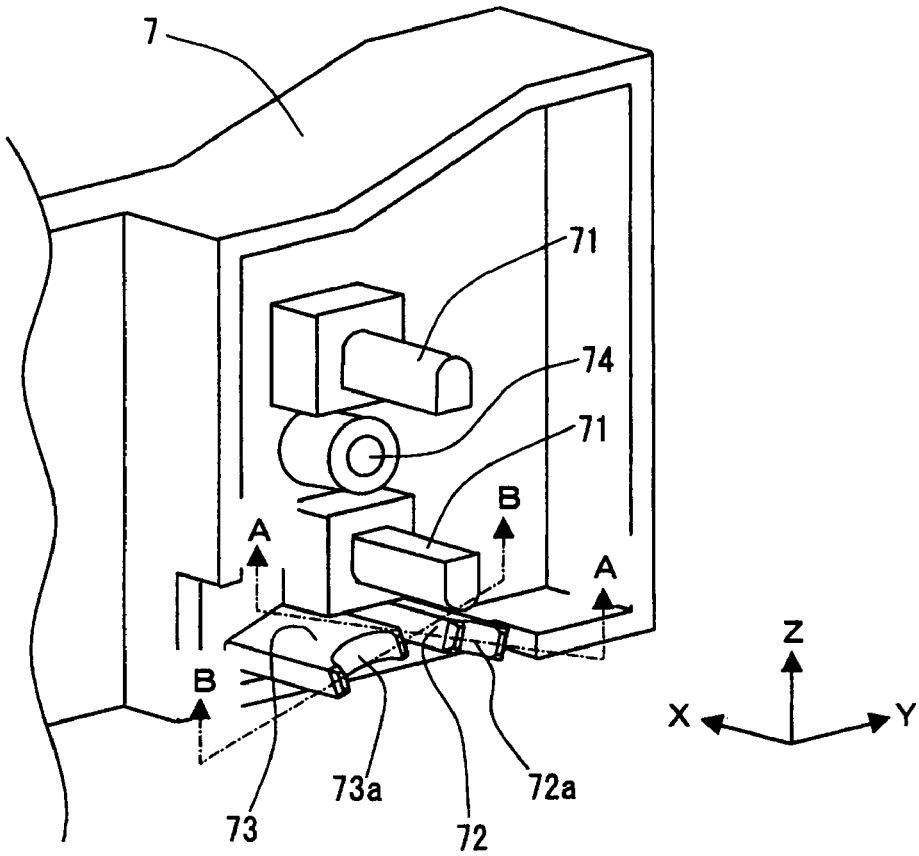
Figure 4B:
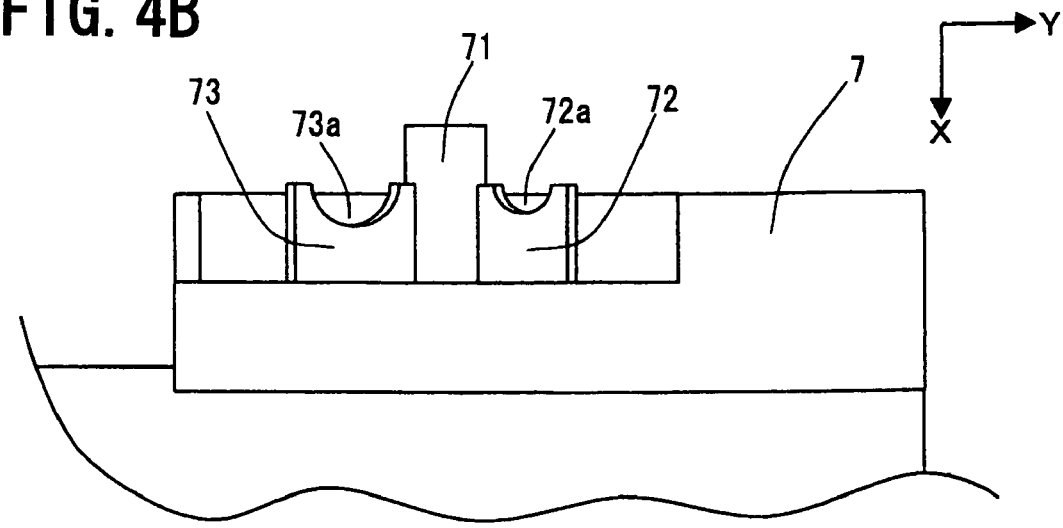
FIG. 4B is a schematic bottom plan view of the part of the cradle.

FIGS. 3A to 3D show a structure of the print misalignment detection sensor 8, in which FIG. 3A is a schematic perspective view as seen from outside, FIG. 3B is a schematic exploded perspective view as seen from the cradle-mounting side, and FIG. 3C is a schematic front view of the print misalignment detection sensor 8, showing a structure of its support member 45, while FIG. 3D is a schematic bottom plan view of the print misalignment detection sensor 8, showing the structure of the support member 45. FIG. 4A and FIG. 4B show structure of a part of the cradle 7 showing a sensor mounting surface of the cradle 7 on which the print misalignment detection sensor 8 is mounted, in which FIG. 4A is a schematic perspective view, and FIG. 4B is a schematic bottom plan view of the part of the cradle 7.

Referring to these Figures, the print misalignment detection sensor 8 comprises: an LED (Light Emitting Diode) 41 which is a light emitting diode for emitting light to be irradiated onto the paper 2; a transmitter lens 42; a PD (Photodetector) 43 which is a light-receiving element for receiving reflection light reflected by the paper 2; a receiver lens 44; and a support member 45 for supporting these LED 41, transmitter lens 42, PD 43 and receiver lens 44, and for being mounted on a side surface of the cradle 7. The support member 45 comprises: a light transmitting groove 51 to form a light transmitting path for the light emitted from the LED to pass; a light receiving groove 52 to form a light receiving path to the PD 43; and mounting holes 56 to 59 for mounting and supporting the LED 41, the transmitter lens 42, the PD 43 and the receiver lens 44.

The cradle 7 comprises: positioning bosses 71, provided on and projected from the support member-mounting side surface thereof, for positioning the support member 45 of the print misalignment detection sensor 8; a light transmitting path rib 72 for causing a part of the light transmitting path of the print misalignment detection sensor 8 to be round-shaped, more specifically causing the light transmitting path to have a round shape as seen in cross-sectional view; a light receiving path rib 73 for causing a part of the light receiving path of the print misalignment detection sensor 8 to be round-shaped, more specifically causing the light receiving path to have a round shape as seen in cross-sectional view; and a cradle screw hole 74 for fixing the support member 45 of the print misalignment detection sensor 8, using a screw. The support member 45 comprises, in addition to the above described elements: boss-fitting positioning holes 81 for inserting and fitting the positioning bosses 71 of the cradle 7; rib insertion portions (notches) 82 and 83 for inserting the light transmitting path rib 72 and the light receiving path rib 73; and a support member screw hole 84 for fixing the support member 45 to the cradle 7, using a screw. The support member 45 is open on the cradle-mounting side thereof.

The light transmitting groove 51 of the support member 45 extends from the mounting hole 56, which is provided for mounting the LED 41, to a light exit opening 61 of the support member 45, and hence of the print misalignment detection sensor 8, via the rib insertion portion 82 for inserting the light transmitting path rib 72 and via the mounting hole 57 for mounting the transmitter lens 42. The light transmitting groove 51 extends substantially straight, and has a substantially U-shaped cross section. The light receiving groove 52 of the support member 45 extends from a light entrance opening 62 of the support member 45, and hence of the print misalignment detection sensor 8, to the mounting hole 59 for mounting the PD 43 via the rib insertion portion 83 for inserting the light receiving path rib 73 and via the mounting hole 58 for mounting the receiver lens 44. The light receiving groove 52 extends substantially straight, and has a substantially U-shaped cross section.

The positioning bosses 71, the light transmitting path rib 72 and the light receiving path rib 73 of the cradle 7 are provided on and projected from the support member-mounting surface on the side of the cradle 7 on which to mount the support member 45 of the print misalignment detection sensor 8. The light transmitting path rib 72 has a substantially semicircular or semi-circle shaped recess 72*a* formed at an end thereof, while the light receiving path rib 73 also has a substantially semicircular recess 73*a* formed at an end thereof. It is designed so that the support member-mounting surface of the cradle 7 closes an opening on a cradle-mounting side of the support member 45 on which to mount the cradle 7.

The print misalignment detection sensor 8 is mounted on the side of the cradle 7 in a manner that the support member 45 is (more specifically the boss-fitting positioning holes 81 of the support member 45 are) fitted to the positioning bosses 71 of the cradle 7, with the LED, the light transmitter lens 42, the PD 43 and the light receiver lens 44 being mounted on the support member 45. Here, an end of the light transmitting path rib 72 of the cradle 7 is inserted into the rib insertion portion 82 of the support member 45, while an end of the light receiving path rib 73 of the cradle 7 is inserted into the rib insertion portion 83 of the support member 45. Further, the opening on a cradle-mounting side of the support member 45 is closed by the support member-mounting surface of the cradle 7. The print misalignment detection sensor 8 is fixed to the cradle 7 by fixing the support member 45 with the screw 20, with the support member 45 being mounted on the cradle 7 in the manner described above.

Figure 5A:
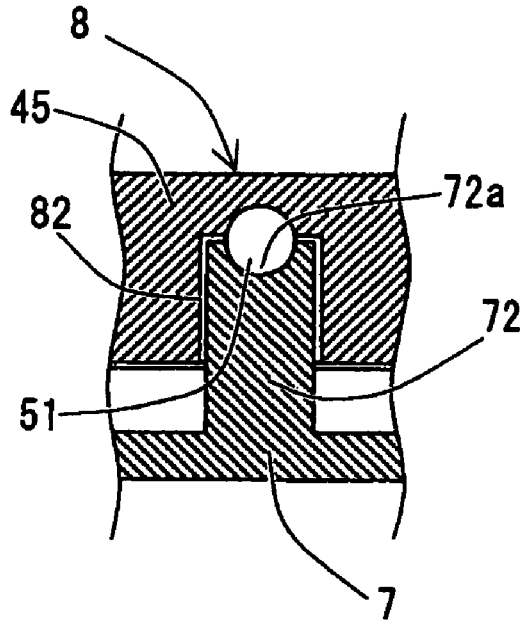
FIG. 5A is a schematic cross-sectional view of a part of the printer along line A-A of FIG. 4A where a light transmitting path rib of the cradle is inserted into a rib insertion portion of the print misalignment detection sensor.
Figure 5B:
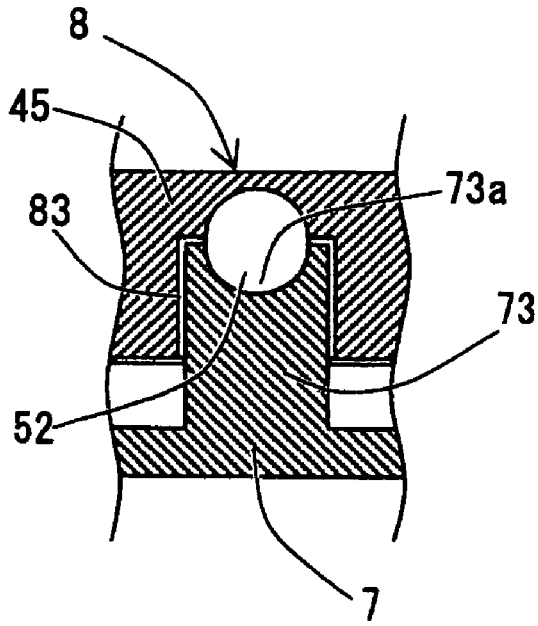
FIG. 5B is a schematic cross sectional view of a part of the printer along line B-B of FIG. 4A where a light receiving path rib of the cradle is inserted into a rib insertion portion of the print misalignment detection sensor.

FIG. 5A and FIG. 5B show parts of the printer 1 where the print misalignment detection sensor 8 is mounted on the cradle 7. More specifically, FIG. 5A is a schematic cross-sectional view along line A-A of FIG. 4A, showing the part where the light transmitting path rib 72 of the cradle 7 is inserted into the rib insertion portion 82 of the print misalignment detection sensor 8. On the other hand, FIG. 5B is a schematic cross-sectional view along line B-B of FIG. 4A, showing the part where the light receiving path rib 73 of the cradle 7 is inserted into the rib insertion portion 83 of the print misalignment detection sensor 8.

As shown in these Figures, where the print misalignment detection sensor 8 is mounted on the cradle 7, an end of the light transmitting path rib 72 of the cradle 7 is inserted into the rib insertion portion 82 of the support member 45 of the print misalignment detection sensor 8, whereby the end of the light transmitting path rib 72 is inserted or intruded into the light transmitting groove 51 of the support member 45 so as to cause a part of the light transmitting path (light transmitting groove 51) at the insertion position of the light transmitting rib 72 to be round-shaped, more specifically cause the light transmitting path to have a round shape at the insertion position as seen in cross-sectional view. Similarly, where the print misalignment detection sensor 8 is mounted on the cradle 7, an end of the light receiving path rib 73 of the cradle 7 is inserted into the rib insertion portion 83 of the support member 45 of the print misalignment detection sensor 8, whereby the end of the light receiving path rib 73 is inserted or intruded into the light receiving groove 52 of the support member 45 so as to cause a part of the light receiving path (light receiving groove 52) at the insertion position of the light receiving rib 73 to be round-shaped, more specifically cause the light receiving path to have a round shape at the insertion position as seen in cross-sectional view.

According to the ink jet printer 1, the light transmitting path rib 72 and the light receiving path rib 73 are inserted into the rib insertion portions 82 and 83 of the print misalignment detection sensor 8 so as to cause the light transmitting path and the light receiving path to have a round shape, as seen in cross-sectional view, at the insertion position of the light transmitting rib 72 and the insertion position of the light receiving rib 73, respectively, as described above. Thereby, unnecessary light is cut (stopped). This reduces irregular reflection of light in the light transmitting path and the light receiving path, making it possible to reduce noise in an output signal of the print misalignment detection sensor 8. Furthermore, since the opening of the print misalignment detection sensor 8 on its cradle-mounting side is closed by the cradle 7, external disturbing light is cut. This further reduces irregular reflection of light in the light transmitting path and the light receiving path, making it possible to further reduce noise in an output signal of the print misalignment detection sensor 8.

Due to the reduced noise in the output signal of the print misalignment detection sensor 8, misalignment of an image printed on a paper 2 can be accurately detected. This makes it possible to properly correct the image misalignment based on the detected image misalignment, and thereby to print a misalignment-free clear image on the paper 2. Furthermore, the positioning bosses 71, the light transmitting path rib 72 and the light receiving path rib 73 that are provided on the cradle 7 serve to position the print misalignment detection sensor 8, making it possible to easily mount the print misalignment detection sensor 8 at a proper position. In addition, the side surface of the cradle 7 is used to close the opening of the print misalignment detection sensor 8 on its cradle-mounting side, thereby making possible to save additional elements and reduce weight.

It is to be noted that the present invention is not limited to the above embodiments, and various modifications are possible. For example, although the above embodiment describes an example in which ribs are provided on both the light transmitting and receiving paths as light transmitting and receiving path ribs 72 and 73, it is possible to provide only one of the light transmitting and receiving path ribs 72 and 73. As compared with a case where none of the light transmitting and receiving path ribs 72 and 73 are present, unnecessary light is cut (stopped) by the light transmitting path rib 72 and/or the light receiving path rib 73 in the light transmitting path and/or the light receiving path, respectively, thereby reducing irregular reflection of light in the light transmitting path and/or the light receiving path. In addition, the rib insertion portion 82 and/or the rib insertion portion 83 are not always necessary. Instead, it is possible to insert or intrude an entire end of the light transmitting path rib 72 and/or an entire end of the light receiving path rib 73 into the light transmitting groove 51 and/or the light receiving groove 52.

The present invention has been described above using presently preferred embodiments, but such description should not be interpreted as limiting the present invention. Various modifications will become obvious, evident or apparent to those ordinarily skilled in the art, who have read the description. Accordingly, the appended claims should be interpreted to cover all modifications and alterations which fall within the spirit and scope of the present invention.

What is claimed is:

1. An ink jet printer for printing an image on a paper, comprising:

a printing head for ejecting ink to print an image on a paper;

a cradle for holding the printing head;

a print misalignment detection sensor comprising a light-emitting element for irradiating light onto the paper and a light-receiving element for receiving reflection light from the paper so as detect misalignment of an image printed on the paper; and a support member for supporting the light-emitting element and the light-receiving element and for being mounted on a side surface of the cradle, wherein: the support member comprises (i) a light transmitting groove having a substantially U-shaped cross section to form a light transmitting path of light emitted from the light-emitting element, (ii) a light receiving groove having a substantially U-shaped cross section to form a light receiving path to the light-receiving element, and (iii) an opening on a cradle-mounting side thereof;

the cradle comprises a rib being provided on and projected from the side surface thereof to mount the support member, and being inserted into the light transmitting groove and/or the light receiving groove, and further having a semicircular recess at an end thereof; and the semicircular recess of the rib inserted into the light transmitting groove and/or the light receiving groove causes the light transmitting path and/or the light receiving path at the insertion position to have a round shape as seen in cross-sectional view.

2. The ink jet printer according to claim 1, wherein the mounting of the support member on the side surface of the cradle causes the opening of the support member to be closed.

3. The ink jet printer according to claim 1, wherein the cradle comprises a positioning boss provided on and projected from the side surface thereof to mount the support member, while the support member comprises a boss-fitting positioning hole for the positioning boss to be fitted to, and a rib insertion portion for the rib of the cradle to be inserted into.

4. The ink jet printer according to claim 1, wherein the semicircular recess of the rib cooperates with the support member to cause the round shape.

* * * * *